US008459635B2

(12) United States Patent
Inoue

(10) Patent No.: US 8,459,635 B2
(45) Date of Patent: Jun. 11, 2013

(54) SHEET FEEDING DEVICE AND IMAGE FORMING APPARATUS

(75) Inventor: Kozo Inoue, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/523,152

(22) Filed: Jun. 14, 2012

(65) Prior Publication Data

US 2012/0326381 A1 Dec. 27, 2012

(30) Foreign Application Priority Data

Jun. 24, 2011 (JP) ..... 2011-140347

(51) Int. Cl.
*B65H 3/52* (2006.01)

(52) U.S. Cl.
USPC ..... 271/124; 271/125; 271/121; 271/117

(58) Field of Classification Search
USPC ..... 271/124, 125, 121, 117
See application file for complete search history.

(56) References Cited

U.S. PATENT DOCUMENTS

| | | | | |
|---|---|---|---|---|
| 5,377,970 | A * | 1/1995 | Kikuchi | 271/121 |
| 7,549,629 | B2 | 6/2009 | Tateishi et al. | |
| 7,748,697 | B2 | 7/2010 | Fujita et al. | |
| 2004/0070137 | A1 * | 4/2004 | Sonoda et al. | 271/121 |

FOREIGN PATENT DOCUMENTS

| | | | |
|---|---|---|---|
| JP | 05294485 | A * | 11/1993 |
| JP | 11-222330 | A | 8/1999 |

* cited by examiner

*Primary Examiner* — Luis A Gonzalez
(74) *Attorney, Agent, or Firm* — Fitzpatrick, Cella, Harper & Scinto

(57) ABSTRACT

A sheet feeding device and an image forming apparatus which can stably separate sheets even when the position of a pressing portion is changed are provided. A guide portion supports sheets from below and guides the sheets to a pressing portion between a sheet feeding roller which is biased in the direction pressing the sheet feeding roller onto the sheets stacked on a sheet stacking portion and a separating member which separates the sheets fed from the sheet feeding roller one by one. The guide portion is linearly lowered together with the separating member with the downward movement of the sheet feeding roller biased by a roller biasing member.

12 Claims, 8 Drawing Sheets

SHEET FEEDING DEVICE AND IMAGE FORMING APPARATUS

BACKGROUND OF THE INVENTION

1. Field of the Invention

The present invention relates to a sheet feeding device and an image forming apparatus, more specifically, to the configuration of a separating portion which separates sheets fed by a sheet feeding roller.

2. Description of the Related Art

Conventionally, an image forming apparatus such as a printer and a copying machine is provided with a sheet feeding device which has a sheet feeding cassette as a sheet storing portion which stacks sheets therein and a sheet feeding portion which separately feeds the sheets stored in the sheet feeding cassette one by one. In such a sheet feeding device, as a separating mechanism which separates the sheets stacked in the sheet feeding cassette one by one, there is e.g., a retard separating mechanism using a feed roller and a retard roller. There is also a separating mechanism which uses a sheet feeding roller which serves as a pickup and feed function and a separating member (a separating roller and a friction pad).

In the separating mechanism, a sheet guide configuration which picks up sheets and conveys the sheets to a separating portion plays an important role to perform stable separation and conveyance. As a proposal about the guide configuration of the separating portion, a roller supporting member which supports the retard roller is provided with a sheet guide which guides the sheets to a nip portion formed between the feed roller and the retard roller (see Japanese Patent Laid-Open No. 11-222330).

In such a conventional sheet feeding device, with the change in the sheet surface height position of the sheets stacked in the sheet feeding cassette, a feeding direction of the sheet fed from the sheet feeding cassette and an angle of a guide surface of the sheet guide is changed. As a result, when the sheets are guided by the sheet guide, resistance force becomes larger and the sheets cannot be conveyed to the nip portion formed between the feed roller and the retard roller Accordingly, the present invention has been made in view of such circumstances, and provides a sheet feeding device and an image forming apparatus which can stably separate sheets.

SUMMARY OF THE INVENTION

A sheet feeding device according to the present invention includes: a sheet storing portion having a sheet stacking portion which stacks sheets thereon and can be lifted and lowered; a sheet feeding roller which is provided above the sheet stacking portion and feeds the sheets stacked on the sheet stacking portion; a supporting portion which supports the sheet feeding roller so that the sheet feeding roller is movable in an up-down direction; a roller biasing member which biases the sheet feeding roller in a direction pressing the sheet feeding roller onto the sheets stacked on the sheet stacking portion; a separating member which is pressed onto the sheet feeding roller and separates the sheets fed by the sheet feeding roller one by one; and a guide portion which guides the sheets to a pressing portion between the sheet feeding roller and the separating member, wherein the guide portion is linearly lowered together with the separating member with the downward movement of the sheet feeding roller biased by the roller biasing member.

According to the present invention, the guide portion which guides the sheets to the pressing portion between the sheet feeding roller and the separating member is linearly lowered together with the separating member with the downward movement of the sheet feeding roller, so that the sheets can be stably separated even when the position of the pressing portion is changed.

Further features of the present invention will become apparent from the following description of exemplary embodiments with reference to the attached drawings.

DESCRIPTION OF THE EMBODIMENTS

Figure 1:
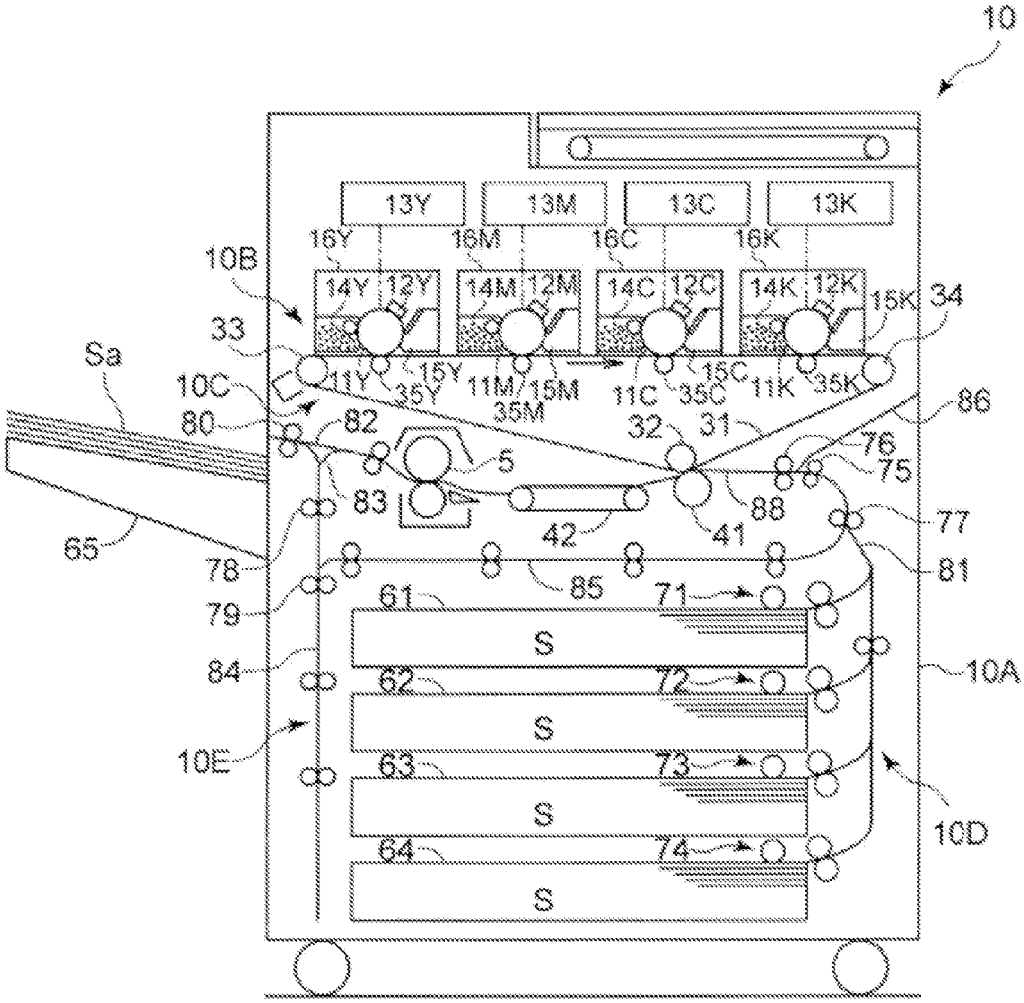
FIG. 1 is a diagram illustrating the schematic configuration of a color laser beam printer which is an example of an image forming apparatus having a sheet feeding device according to a first embodiment of the present invention.

Hereinafter, embodiments of the present invention will be described in detail with reference to the drawings. FIG. 1 is a diagram illustrating the schematic configuration of a color laser beam printer which is an example of an image forming apparatus having a sheet feeding device according to a first embodiment of the present invention. FIG. 1 shows a color laser beam printer 10 and a color laser beam printer body (hereinafter, called a printer body) 10A. The printer body 10A has an image forming portion 10B which forms an image on each sheet S, an intermediate transfer portion 10C, a fixing device 5, and a sheet feeding portion 10D which feeds the sheet S to the image forming portion 10B. The color laser beam printer 10 can form an image on the back side of the sheet, and has a re-conveying portion 10E which reverses the sheet S in which an image is formed on the front side (the first side) thereof and conveys the sheet S to the image forming portion 10B.

The image forming portion 10B has process stations 16Y, 16M, 16C, and 16K which are arranged in the substantially horizontal direction and form toner images in four colors of yellow (Y), magenta (M), cyan (C), and black (Bk). The process stations 16Y, 16M, 16C, and 16K have photosensitive drums 11Y, 11M, 11C, and 11K which are image bearing members which bear the toner images in four colors of yellow, magenta, cyan, and black and are driven by a stepping motor, not illustrated, respectively.

The image forming portion 10B has charging devices 12Y, 12M, 12C, and 12K which uniformly charge the surfaces of the photosensitive drums. The image forming portion 10B has exposing devices 13Y, 13M, 13C, and 13K which irradiate the photosensitive drums rotated at a fixed speed, with a laser beam based on image information to form electrostatic latent images thereon. The image forming portion 10B has developing devices 14Y, 14M, 14C, and 14K which provide toners in yellow, magenta, cyan, and black onto the electrostatic latent images formed on the photosensitive drums to develop the toner images. The charging devices 12Y, 12M, 12C, and 12K, the exposing devices 13Y, 13M, 13C, and 13K, and the developing devices 14Y, 14M, 14C, and 14K are disposed along the rotation direction around the photosensitive drums 11Y, 11M, 11C, and 11K, respectively.

The sheet feeding portion 10D has sheet feeding devices 71 to 74 which are provided in the lower portion of the printer body and feed the sheets S stacked and stored in sheet feeding cassettes 61 to 64 as a sheet storing portion which stores the sheets S. When the image forming operation is started, the sheet feeding devices 71 to 74 separately feed the sheets S from the sheet feeding cassettes 61 to 64. Thereafter, the separately fed sheet S passes through a conveying vertical path 81 to reach a conveying horizontal path 88, and is then conveyed to a registration roller 76 provided in the conveying horizontal path 88.

Here, the sheet S is abutted onto the registration roller 76 to form a loop, thereby allowing the leading edge of the sheet S to follow the registration roller 76 to correct skew feeding. In addition, in the registration roller 76, the sheet S is conveyed to a secondary transfer portion at a predetermined timing, so as to be timed to coincide with image forming onto the sheet S, that is, with the toner images born on an intermediate transfer belt which will be described later. When the sheet S is conveyed, the registration roller 76 is stopped, so that the sheet S is abutted onto the stopped registration roller 76 and is then bent. Thereafter, by the rigidity of the sheet S, the sheet leading edge is aligned with the nip of the registration roller 76 to correct the skew feeding of the sheet S.

The intermediate transfer portion 10C has an intermediate transfer belt 31 which is rotationally driven along the array direction of the process stations 16Y, 16M, 16C, and 16K indicated by an arrow in synchronization with the outer circumferential velocity of the photosensitive drums 11Y, 11M, 11C, and 11K. Here, the intermediate transfer belt 31 is entrained on a driving roller 33, a driven roller 32 which forms a secondary transfer region across the intermediate transfer belt 31, and a tension roller 34 which gives a moderate tension to the intermediate transfer belt 31 by the biasing force of a spring, not illustrated.

The intermediate transfer belt 31 has, on its inside, four primary transfer rollers 35Y, 35M, 35C, and 35K which configure a primary transfer portion and nip the intermediate transfer belt 31 together with the photosensitive drums 11Y, 11M, 11C, and 11K, respectively. The primary transfer rollers 35Y, 35M, 35C, and 35K are connected to a transfer bias power source, not illustrated. The primary transfer rollers 35Y, 35M, 35C, and 35K apply a transfer bias to the intermediate transfer belt 31, so that the toner images in the respective colors on the photosensitive drums are sequentially multi-transferred onto the intermediate transfer belt 31 to form a full color image on the intermediate transfer belt 31.

A secondary transfer roller 41 is arranged to be opposite the driven roller 32, is abutted onto the surface on the lowest side of the intermediate transfer belt 31, and nips and conveys the sheet S conveyed by the registration roller 76 together with the intermediate transfer belt 31. When the sheet S passes through a nip portion between the secondary transfer roller 41 and the intermediate transfer belt 31, a bias is applied to the secondary transfer roller 41 to secondarily transfer the toner images on the intermediate transfer belt onto the sheet S. The fixing device 5 fixes the toner images formed on the sheet via the intermediate transfer belt 31, onto the sheet S, and applies heat and pressure onto the sheet S which holds the toner images and passes through the fixing device 5, thereby fixing the toner images.

Next, the image forming operation of the color laser beam printer 10 will be described. When the image forming operation is started, in the process station 16Y located on the uppermost stream in the rotation direction of the intermediate transfer belt 31, the exposing device 13Y irradiates the photosensitive drum 11Y with a laser beam to form a yellow latent image on the photosensitive drum. Thereafter, the developing device 14Y develops the latent image with the yellow toner to form the yellow toner image. Then, the primary transfer roller 35Y to which a high voltage is applied primarily transfers the yellow toner image formed on the photosensitive drum 11Y, onto the intermediate transfer belt 31 in a primary transfer region.

Then, together with the intermediate transfer belt 31, the toner image is conveyed to the primary transfer region which includes the photosensitive drum 11M and the transfer roller 35M of the next process station 16M in which after the process station 16Y, a magenta toner image is formed with a delay of a time to convey the yellow toner image. The magenta toner image is then transferred onto the yellow toner image on the intermediate transfer belt so that the edges of the images are matched. Hereinafter, the same process is repeated, so that the toner images in four colors are primarily transferred onto the intermediate transfer belt 31 to form a full color image on the intermediate transfer belt. The transferred toners remaining on the photosensitive drums are collected by photosensitive cleaners 15Y, 15M, 15C, and 15K for the next image forming.

In addition, along with the toner image forming operation, the sheets S stored in the sheet feeding cassettes 61 to 64 are separately fed by the sheet feeding devices 71 to 74, and the separately fed sheet S is conveyed to the registration roller 76 through a conveying roller 77. At this time, the registration roller 76 is stopped, so that the sheet S is abutted onto the stopped registration roller 76 to correct the skew feeding of the sheet S. The sheet S whose skew feeding is corrected is conveyed to the nip portion between the secondary transfer roller 41 and the intermediate transfer belt 31 by the registration roller 76 which starts rotation when the sheet leading edge and the toner images formed on the intermediate transfer belt 31 are matched. When the sheet S is nipped and conveyed between the secondary transfer roller 41 and the intermediate transfer belt 31 and passes through the nip portion between the secondary transfer roller 41 and the intermediate transfer belt 31, a bias is applied to the secondary transfer roller 41 to secondarily transfer the toner images on the intermediate transfer belt.

Then, a pre-fixing conveying device 42 conveys the sheet S onto which the toner images are secondarily transferred, to the fixing device 5. The fixing device 5 applies a predetermined pressing force of the counter roller or the belt and typically, the heating effect of the heat source of a heater to meltably fix the toner images onto the sheet S. Here, the color laser beam printer 10 has a one-side mode which performs image forming on one side of the sheet S, and a duplex mode which performs image forming on both sides of the sheet. Path selection is performed by a switching member, not illustrated, in order to convey the sheet S having the fixed image to a discharge conveying path 82 in the one-side mode, and in order to convey the sheet S having the fixed image to a reverse guiding path 83 in the duplex mode.

Here, in the one-side mode, the sheet S having the fixed image passes through the discharge conveying path 82, and is then discharged to a discharge tray 65 by a discharge roller 80. In addition, in the duplex mode, the sheet S passes through the reverse guiding path 83, and is then drawn into a switch-back path 84 by a pair of first reversing rollers 78 and a pair of second reversing rollers 79. Thereafter, the sheet S whose leading and trailing edges are reversed is conveyed to a duplex conveying path 85 by the switch-back operation of the forward and reverse rotation of the pair of second reversing rollers 79.

Then, the sheet S conveyed in the duplex conveying path 85 is timed to the conveyance of the sheet S of the following job by the sheet feeding devices 71 to 74 so as to be joined into the conveying vertical path 81, and is then fed from the conveying horizontal path 88 through the registration roller 76 to the secondary transfer portion. The image forming process with respect to the back side (the second side) is the same as the front side (the first side).

Figure 2:
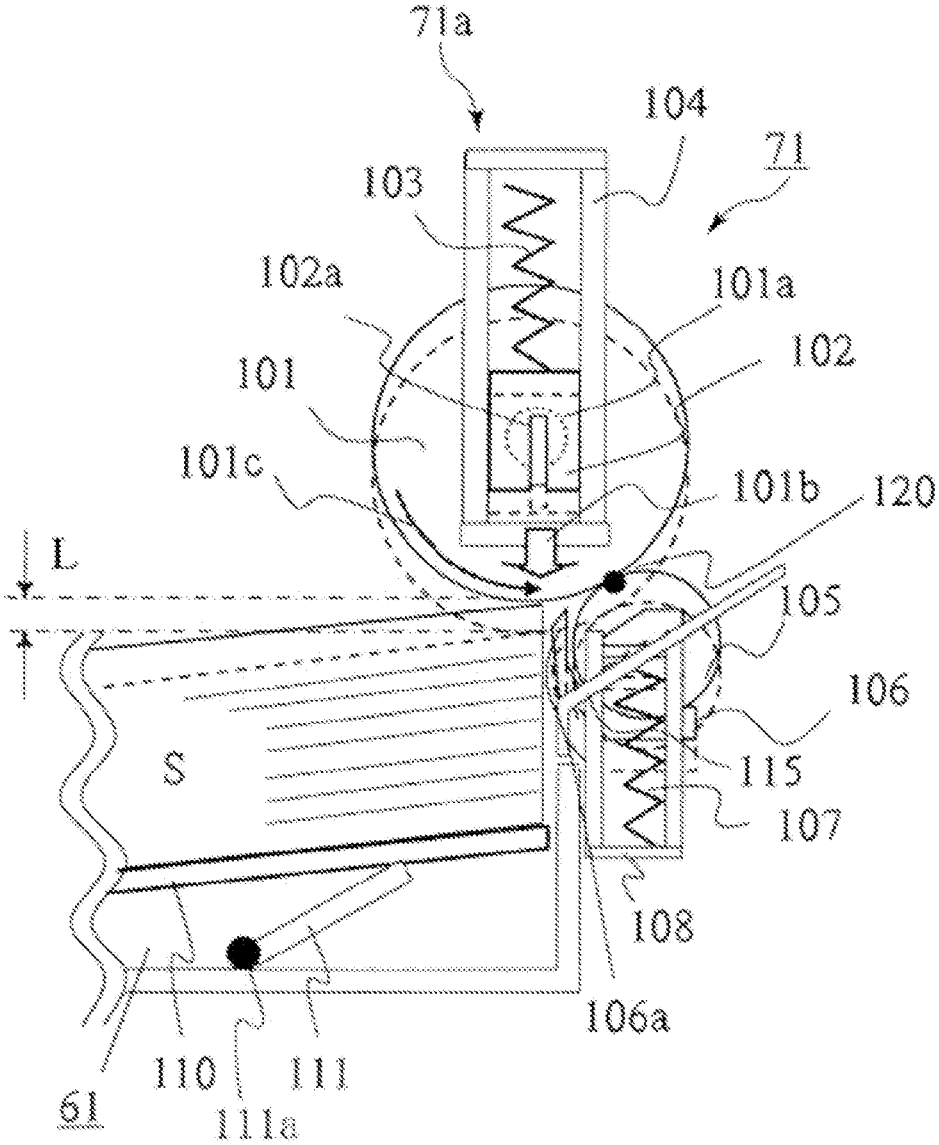
FIG. 2 is a diagram illustrating the configuration of the sheet feeding device of the color laser beam printer.

FIG. 2 is a diagram illustrating the configuration of the sheet feeding device 71. The remaining sheet feeding devices 72 to 74 have the same configuration. The sheet feeding device 71 has the sheet feeding cassette 61 as a sheet storing portion which has a sheet supporting plate 110 as a sheet stacking portion which stacks the sheets S thereon and can be lifted and lowered and is detachably attached to the printer body 10A serving as a sheet feeding device body. The sheet feeding device 71 also has a sheet feeding roller 101 as a feeding roller which is provided above the sheet supporting plate 110 so as to be movable in the up-down direction and feeds the sheets S stacked on the sheet supporting plate 110.

In FIG. 2, a separating roller 105 is a separating member which is pressed onto the sheet feeding roller 101 so as to be contacted thereonto and moved away therefrom, and separates the sheets fed by the sheet feeding roller 101. The separating roller 105 and the sheet feeding roller 101 configure a separating portion which separately feeds the sheets.

Figure 4:
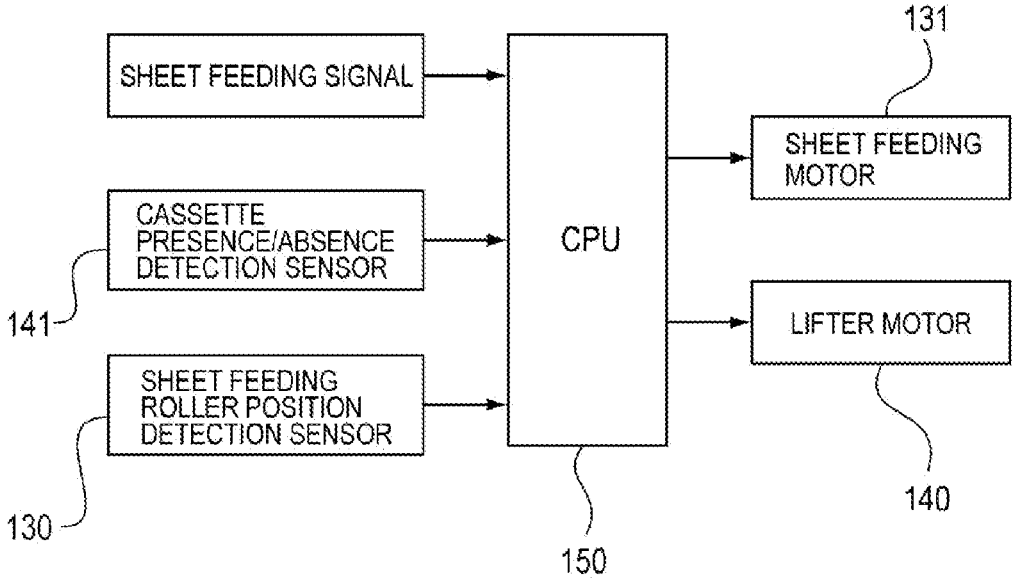
FIG. 4 is a control block diagram of the sheet feeding device.

Here, the sheet supporting plate 110 is turned in the up-down direction about a supporting point, not illustrated, by a lifting/lowering mechanism which has a lifter motor 140 illustrated in FIG. 4, a driving gear, not illustrated, and a lifter 111 which is turned in the up-down direction with a lifter shaft 111*a* as a supporting point. At the time of sheet feeding, the lifter 111 is turned upward to lift the sheet supporting plate 110, and at the time of drawing out the sheet feeding cassette 61, the sheet supporting plate 110 is lowered integrally with the lifter 111 by its own weight or the load of the sheets with the draw-out operation of the sheet feeding cassette 61. Further, when the sheets S are fed to lower the height of the uppermost sheet, the lifter motor 140 is driven to lift the sheet supporting plate 110 so that the height of the uppermost sheet is feedable.

In addition, the sheet feeding roller 101 is rotatably supported by a sheet feeding roller bearing 102. Here, the sheet feeding roller bearing 102 is pressed substantially downward as indicated by an arrow 101*b* by a sheet feeding roller pressing spring 103 which is a roller biasing member, and is supported by a sheet feeding frame 104 so as to be slidable up and down. That is, in this embodiment, the sheet feeding roller 101 is pressed substantially downward by the sheet feeding roller pressing spring 103 via the sheet feeding roller bearing 102, and is supported by the sheet feeding frame 104 so as to be linearly slidable up and down. In this embodiment, the sheet feeding roller bearing 102 and the sheet feeding frame 104 configure a supporting portion 71*a* which supports the sheet feeding roller 101 so that the sheet feeding roller 101 is linearly movable in the up-down direction.

Figure 3:
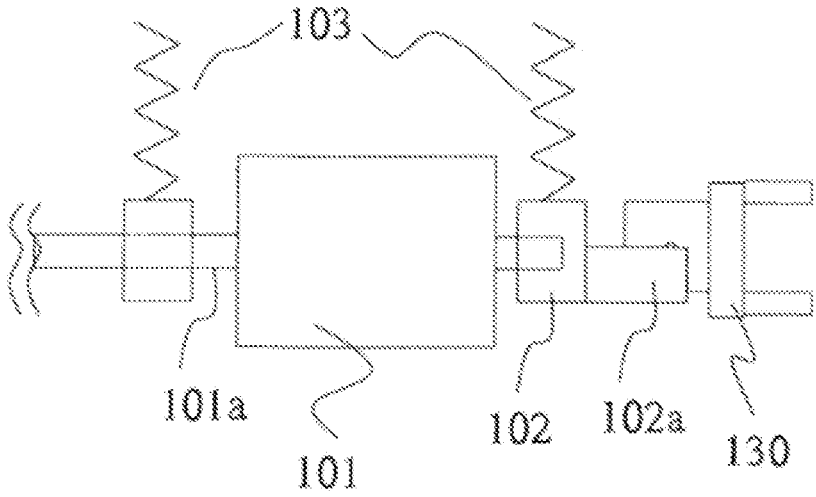
FIG. 3 is a diagram illustrating the configuration of a sheet feeding roller position detection sensor which detects the position of a sheet feeding roller provided in the sheet feeding device.

When the sheets are sequentially fed as described later, the sheet feeding roller 101 is gradually lowered integrally with the sheet feeding roller bearing 102. The sheet feeding roller bearing 102 has a projecting portion 102*a*. In addition, as illustrated in FIG. 3, the printer body 10A has a sheet feeding roller position detection sensor 130 as a sensor portion which detects the projecting portion 102*a* as a flag sensor. When the sheet feeding roller 101 is lowered by a predetermined amount, the sheet feeding roller position detection sensor 130 detects this.

Then, as illustrated in FIG. 4, the detection signal of the sheet feeding roller position detection sensor 130 is input to a CPU 150 which controls the sheet feeding operation of the sheet feeding device 71. The sheet feeding roller position detection sensor 130, the lifter motor 140, and a sheet feeding motor 131 which drives the sheet feeding roller 101 are connected to the CPU 150. A cassette presence/absence detection sensor 141 which detects whether the sheet feeding cassette is attached to the printer body 10A is also connected to the CPU 150. In addition, a sheet feeding signal which starts the sheet feeding operation is input from an external PC, not illustrated.

The position of the sheet feeding roller 101 is detected, the detection signal is input from the sheet feeding roller position detection sensor 130 as a sheet surface detecting portion which detects the height of the uppermost sheet stacked on the sheet supporting plate 110, and the CPU 150 drives the lifter motor 140 for a predetermined time. With this, the sheet supporting plate 110 is lifted. Such lifting of the sheet supporting plate 110 allows the sheet feeding roller 101 to be pressed onto the sheets S by the sheet feeding roller pressing spring 103, thereby providing a sheet feedable pressing force to the sheets S.

The separating roller 105 incorporates a torque limiter, not illustrated. The separating roller 105 is followably rotated by the rotational force of the sheet feeding roller 101, and when only one sheet S is fed to a separating nip 120 which is a pressing portion between the sheet feeding roller 101 and the separating roller 105, the separating roller 105 is followably rotated as-is. In addition, when two or more sheets S are fed, the followable rotation of the separating roller 105 is stopped by the torque limiter. The sheets S are separately conveyed in the substantial position of the separating nip 120.

Figure 5:
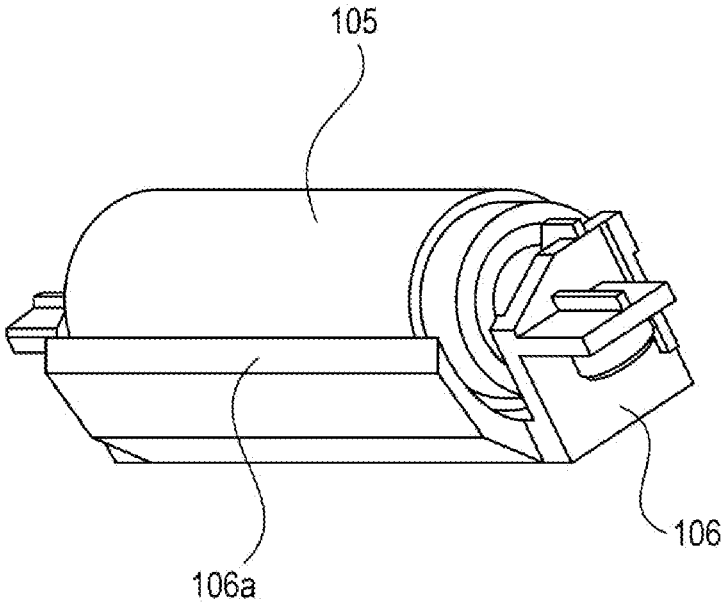
FIG. 5 is a perspective view of a separating roller and a separating roller supporting portion provided in the sheet feeding device.

As illustrated in FIG. 5, the separating roller 105 is held so as to be movable in the up-down direction by a separating roller supporting portion 106 having a guide portion 106*a* which guides the sheets S to the separating nip 120, and is pressed onto the sheet feeding roller 101 by the separation pressing spring 107. Here, the separating roller supporting portion 106 is held linearly slidably by a separating holder 108 fixed to the printer body 10A illustrated in FIG. 2. That is, the separating roller 105 is held linearly slidably by the printer body 10A via the separating roller supporting portion 106 and the separating holder 108.

The spring force of the separation pressing spring 107 which biases the separating roller 105 is set to be smaller than the spring force of the sheet feeding roller pressing spring 103 as a sheet feeding roller biasing portion which biases the sheet feeding roller 101. As described later, when the sheets are sequentially fed to lower the position of the uppermost sheet, the sheet feeding roller 101 can be lowered by pressing down the separating roller 105.

Here, the separating roller supporting portion 106 is provided linearly slidably in the printer body 10A, so that when the sheet feeding roller 101 is lowered, the separating roller supporting portion 106 is also linearly lowered together with the separating roller 105. When the separating roller supporting portion 106 is linearly lowered, the guide portion 106*a* which supports the sheets from below and guides the sheets to the separating nip 120 is lowered holding the same posture.

In FIG. 2, a fixing guide 115 is arranged on the side in the width direction orthogonal to the sheet feeding direction of the separating roller supporting portion 106, and guides the sheets S from the upstream to the downstream of the separating nip 120. The fixing guide 115 is fixed to the printer body 10A, and is arranged downward from the lowest point position of the separating nip 120 during the sheet feeding operation indicated by the dashed line of FIG. 2. In other words, the fixing guide 115 is arranged downward from the tangent line of the sheet feeding roller 101 passing through the separating nip 120 at a lower limit during the sheet feeding operation. The fixing guide 115 is provided in such a position, so that even when the separating nip 120 is moved to the lowest point position, the sheets can be reliably guided to the separating nip 120.

Figure 6:
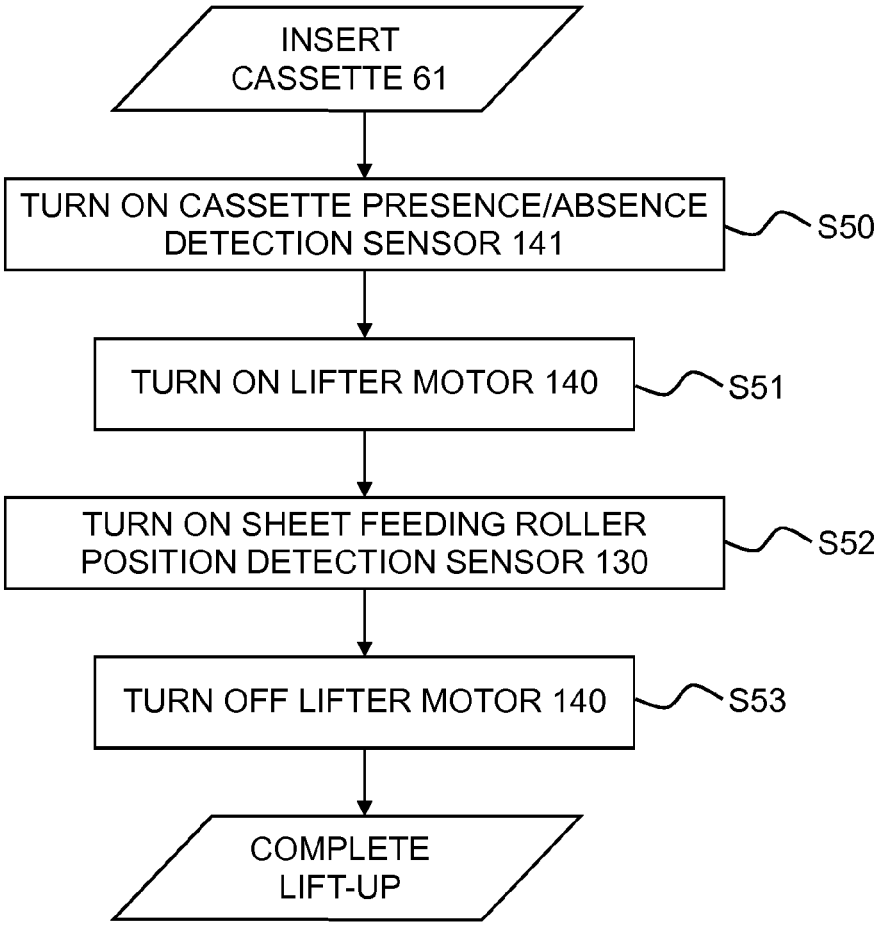
FIG. 6 is a flowchart illustrating lift-up control which lifts sheets after a sheet feeding cassette of the sheet feeding device is inserted into a printer body.

The lift-up control of the sheet feeding device 71 in which the sheets S are lifted after the sheet feeding cassette is inserted into the printer body 10A will be described with reference to the flowchart illustrated in FIG. 6.

When the sheet feeding cassette 61 which stacks the sheets S therein is inserted into the printer body 10A, the cassette presence/absence detection sensor 141 is turned on (S50) and the lifter motor 140 starts driving (on) (S51). The driving force of the lifter motor 140 is transmitted to the lifter 111, and the sheet supporting plate 110 which stacks the sheets S thereon is then turned upward to lift up the sheets S. Thereafter, the uppermost sheet S is abutted onto the sheet feeding roller 101.

Here, as already described, the sheet feeding roller 101 is pressed substantially downward by the sheet feeding roller pressing spring 103, and is then supported by the sheet feeding frame 104 so as to be slidable up and down. The sheet feeding roller 101 is lifted against the pressing force of the sheet feeding roller pressing spring 103 after the sheet is abutted. When the sheet feeding roller 101 is lifted, as illustrated in FIG. 3, the sheet feeding roller position detection sensor 130 detects the projecting portion 102*a* and is then turned on (S52).

When the sheet feeding roller position detection sensor 130 is turned on, the CPU 150 stops the driving of the lifter motor 140 (off) when a predetermined time elapses (S53). With this, the initial lift-up is completed. When the lift-up is completed, the sheet feeding roller pressing spring 103 provides the sheet feedable pressing force with respect to the sheets S to the sheet feeding roller 101.

Figure 7:
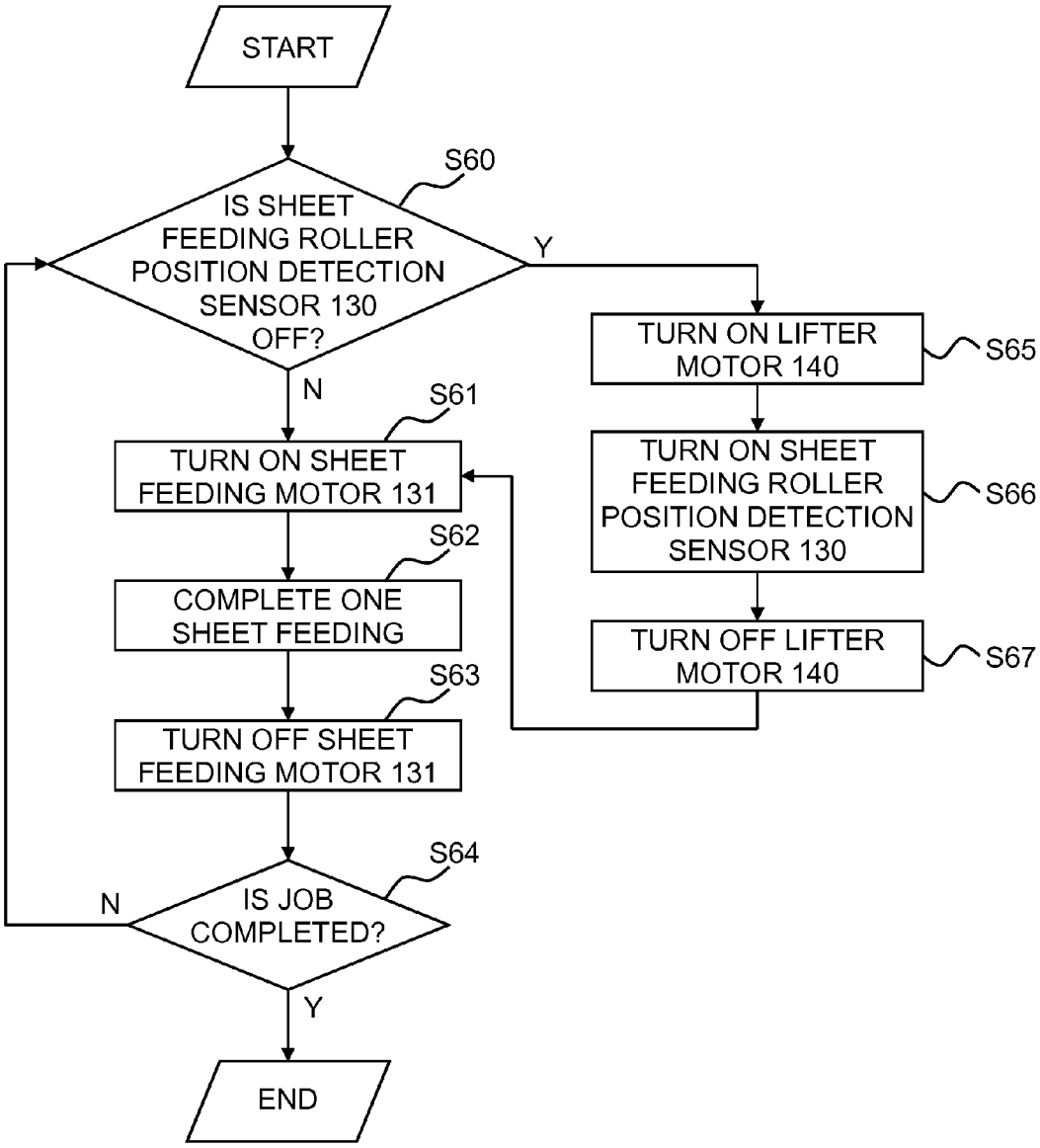
FIG. 7 is a flowchart illustrating sheet feeding operation control of the sheet feeding device and lift-up operation control during the sheet feeding operation.

The sheet feeding operation control of the sheet feeding device 71 and the lift-up operation control during the sheet feeding operation will be described with reference to the flowchart illustrated in FIG. 7.

After the initial lift-up operation is completed, the CPU 150 receives the sheet feeding signal from the external PC, not illustrated, and then starts the driving of the sheet feeding motor 131. Here, the driving force of the sheet feeding motor 131 is transmitted to the sheet feeding roller 101, and the sheet feeding roller 101 is then rotated in the direction of an arrow 101*c* illustrated in FIG. 2. The sheets are fed by the sheet feeding roller 101, and are then conveyed to the separating nip 120 formed between the sheet feeding roller 101 and the separating roller 105. When passing through the separating nip 120, the sheets are separately conveyed one by one in the substantial position of the separating nip 120. Thereafter, as described above, the separated sheet is fed to the conveying vertical path 81 to complete one sheet feeding operation.

At this time, when the sheet feeding roller position detection sensor 130 is not off (N of S60), that is, when the sheet feeding roller position detection sensor 130 is on, the lifter motor 140 is not driven, so that the sheet feeding motor 131 remains on (S61). When one sheet feeding is completed (S62), the sheet feeding motor is turned off (S63). Thereafter, it is determined whether JOB is completed (S64), and when JOB is not completed (N of S64), S60 to S64 are repeated.

Each time one sheet feeding is completed, the sheet surface position of the uppermost sheet is lowered by an amount for one sheet. At this time, the sheet feeding roller 101 is lowered so as to follow the sheet surface position of the uppermost sheet by the pressing force of the sheet feeding roller pressing spring 103.

When the sheet feeding roller 101 is lowered by a distance L illustrated in FIG. 2 so as to be lowered to the position indicated by the dashed line, the sheet feeding roller position detection sensor 130 is turned off. When the sheet feeding roller position detection sensor 130 is turned off (Y of S60), the lifter motor 140 is driven (on) (S65). The sheet supporting plate 110 is turned upward to lift up the sheets S. Thereafter, the uppermost sheet S is abutted onto the sheet feeding roller 101, and the sheet feeding roller 101 is then lifted against the pressing force of the sheet feeding roller pressing spring 103.

When the position of the lifted sheet feeding roller 101 is detected to turn on the sheet feeding roller position detection sensor 130 (S66), the driving of the lifter motor 140 is stopped after a predetermined time elapses (S67). By the control, the position of the upper surface of the uppermost sheet of the sheets S stacked on the sheet supporting plate 110 during the sheet feeding operation is maintained in the range of the distance L of FIG. 2.

As already described, each time one sheet feeding is completed, the sheet feeding roller 101 is lowered so as to follow the sheet surface position of the uppermost sheet by the pressing force of the sheet feeding roller pressing spring 103. As already described, the spring force of the separation pressing spring 107 is set to be smaller than the spring force of the sheet feeding roller pressing spring 103, so that when the sheet feeding roller 101 is lowered, the position of the separating roller 105 and the separating roller supporting portion 106 is also lowered, and the position of the separating nip 120 is also lowered.

Here, when the separating roller supporting portion 106 is linearly lowered together with the separating roller 105, the guide portion 106*a* is lowered holding the same posture, as already described. Therefore, even when the position of the separating nip 120 is lowered, the sheets fed by the sheet feeding roller 101 are stably guided to the separating nip 120 by the guide portion 106*a*. With this, even when the position of the separating nip 120 is changed, the sheets can be stably separated.

As described above, in this embodiment, the guide portion 106*a* which guides the sheets to the separating nip 120 is linearly lowered together with the separating roller 105 with the downward movement of the sheet feeding roller 101. With this, the guide portion 106*a* can hold the same posture with respect to the position of the separating nip 120, so that even when the position of the separating nip 120 is changed with the change of the sheet surface position of the uppermost sheet, the sheets S can be stably separated.

Figure 8:
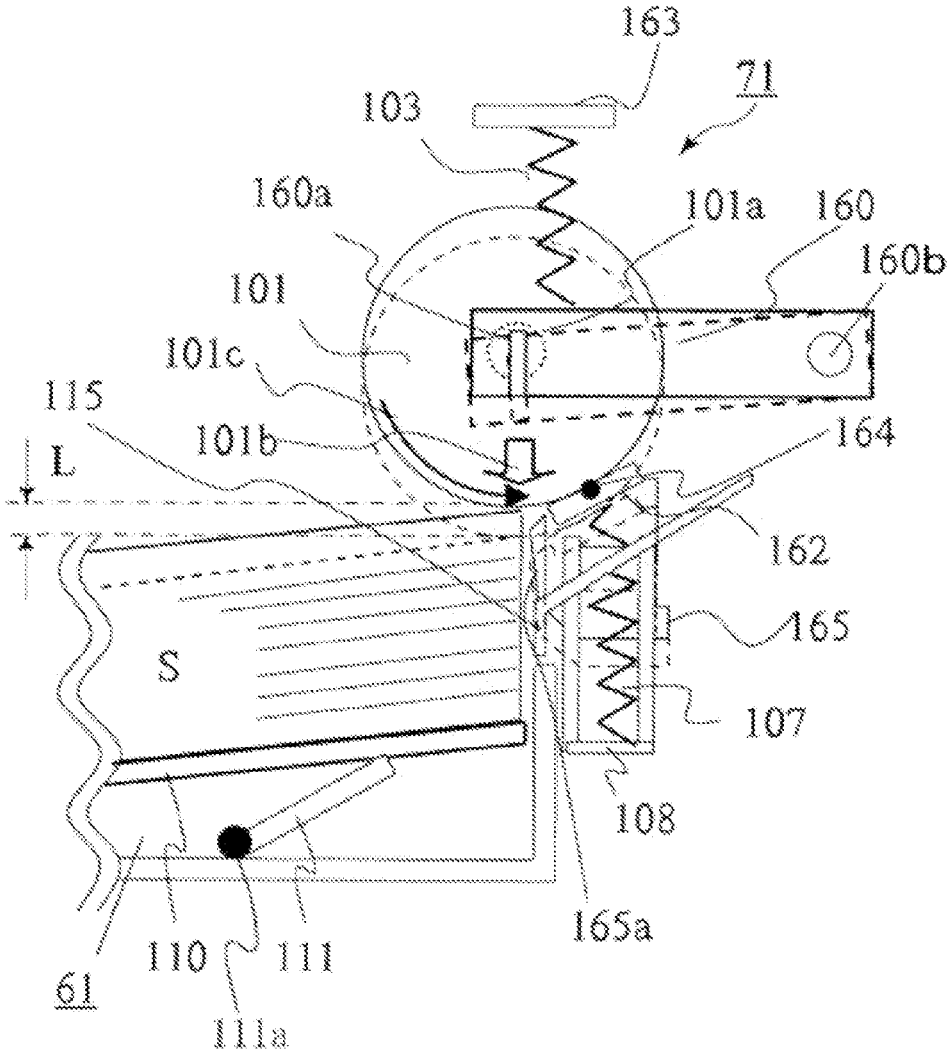
FIG. 8 is a diagram illustrating the configuration of the sheet feeding device according to a second embodiment of the present invention.

A second embodiment of the present invention will be described. FIG. 8 is a diagram illustrating the configuration of a sheet feeding device according to this embodiment. In FIG. 8, the same reference numerals as FIG. 2 indicate the same or corresponding parts.

In FIG. 8, a sheet feeding roller holder 160 is turned about a supporting point 160*b*, and the sheet feeding roller 101 is then rotatably supported at the turning end of the sheet feeding roller holder 160. In addition, a friction pad 162 is in press contact with the sheet feeding roller 101 to form a separating nip 164.

Here, the sheet feeding roller holder 160 which is a separating member supporting portion movable in the up-down direction is biased downward by the sheet feeding roller pressing spring 103 as the sheet feeding roller biasing portion. With this, the sheet feeding roller 101 is pressed substantially downward by the sheet feeding roller pressing spring 103 via the sheet feeding roller holder 160, and is then rotatable in the up-down direction. In addition, the friction pad 162 has a friction resistance between the friction pad 162 and the sheets S larger than the friction resistance between the sheets, so that the sheets can be separated one by one in the substantial position of the separating nip 164.

Here, the friction pad 162 is held by a friction pad supporting portion 165 having a guide portion 165*a* which supports the sheets S from below to guide the sheets S to the separating nip 164, and is pressed onto the sheet feeding roller 101 by the separation pressing spring 107. Here, the friction pad supporting portion 165 is held linearly slidably by the separating holder 108 fixed to the device body. That is, the friction pad 162 is held linearly slidably by the device body via the friction pad supporting portion 165 and the separating holder 108.

The spring force of the separation pressing spring 107 which biases the friction pad 162 is set to be smaller than the spring force of the sheet feeding roller pressing spring 103 which biases the sheet feeding roller 101. With this, when the sheets are sequentially fed to lower the position of the uppermost sheet, the sheet feeding roller 101 can be lowered by pressing down the friction pad 162.

Here, the friction pad supporting portion 165 is provided linearly slidably, so that when the sheet feeding roller 101 is lowered, the friction pad supporting portion 165 is also linearly lowered together with the friction pad 162. When the friction pad supporting portion 165 is linearly lowered, the guide portion 165*a* which supports the sheets from below and guides the sheets to the separating nip 164 is lowered holding the same posture. Therefore, even when the position of the separating nip 164 is lowered, the sheets fed by the sheet feeding roller 101 are stably guided to the separating nip 164 by the guide portion 165*a*. With this, even when the position of the separating nip 164 is changed, the sheets can be stably separated.

As described above, in this embodiment, the guide portion 165*a* is linearly lowered together with the friction pad 162 with the downward movement of the sheet feeding roller 101. With this, the guide portion 165*a* can hold the same posture with respect to the separating nip 164, so that even when the position of the separating nip 164 is changed with the change of the sheet surface position of the uppermost sheet, the sheets S can be stably separated.

Although the two pressing configurations which press the sheet feeding roller 101 and the two separating units have been described above, these combinations are not limited to the first and second embodiments. In addition, although in the above description, the separating roller incorporates the torque limiter, the separating roller may be separated from the torque limiter. Further, for the control of the lifter motor 140, although the detected result of the position of the sheet feeding roller 101 is fed back and controlled, the present invention is not limited to this. For instance, the position of the uppermost sheet S may be detected by a flag sensor and a photo interrupter to feed back the result to the control of the lifter motor 140.

The separating unit should be linearly slid, and is not limited to be slid in the vertical direction. The shape of the guide portion 106*a* is not limited to that illustrated in FIG. 2, and should be provided on the upstream in the sheet feeding direction from the position of the separating nip 120 to guide the sheets to the separating nip position.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-140347, filed Jun. 24, 2011, which is hereby incorporated by reference herein in its entirety.

What is claimed is:

1. A sheet feeding device comprising:

a sheet storing portion having a sheet stacking portion which stacks sheets thereon and can be lifted and lowered;

a sheet feeding roller which is provided above the sheet stacking portion and feeds the sheets stacked on the sheet stacking portion;

a supporting portion which supports the sheet feeding roller so that the sheet feeding roller is movable in an up-down direction;

a roller biasing member which biases the sheet feeding roller in a direction pressing the sheet feeding roller onto the sheets stacked on the sheet stacking portion;

a separating member which is pressed onto the sheet feeding roller and separates the sheets fed by the sheet feeding roller one by one; and a guide portion which guides the sheets to a pressing portion between the sheet feeding roller and the separating member, wherein the guide portion is linearly lowered together with the separating member with the downward movement of the sheet feeding roller biased by the roller biasing member.

2. The sheet feeding device according to claim 1, further comprising a separating member supporting portion which supports the separating member and is movable in the up-down direction, the guide portion being provided on the separating member supporting portion at an upstream in a sheet feeding direction of the pressing portion.

3. The sheet feeding device according to claim 1, further comprising a fixing guide which guides the sheets to the pressing portion between the sheet feeding roller and the separating member, the fixing guide being arranged below the tangent line of the sheet feeding roller when the pressing portion is at a lower limit.

4. A sheet feeding device comprising:

a sheet storing portion having a sheet stacking portion which stacks sheets thereon and can be lifted and lowered;

a sheet feeding roller which is provided above the sheet stacking portion and feeds the sheets stacked on the sheet stacking portion;

a supporting portion which supports the sheet feeding roller so that the sheet feeding roller is movable in an up-down direction;

a roller biasing member which biases the sheet feeding roller in a direction pressing the sheet feeding roller onto the sheets stacked on the sheet stacking portion;

a separating member which is pressed onto the sheet feeding roller and separates the sheets fed by the sheet feeding roller one by one; and a separating roller supporting portion which holds the separating member;

a separating holder which slidably holds the separating roller supporting portion in an up-down direction; and a guide portion which is provided on the separating roller supporting portion and guides the sheets fed by the sheet feeding roller to a pressing portion between the sheet feeding roller and the separating member.

5. The sheet feeding device according to claim 4, wherein the supporting portion includes a sheet feeding frame which supports the sheet feeding roller so as to be slidable up and down.

6. The sheet feeding device according to claim 4, wherein the supporting portion includes a sheet feeding roller holder which is turned about a supporting point and rotatably supports the sheet feeding roller so as to be up and down.

7. An image forming apparatus in which an image forming portion forms an image on a sheet fed from a sheet feeding device, wherein the sheet feeding device has:

a sheet storing portion having a sheet stacking portion which stacks sheets thereon and can be lifted and lowered;

a sheet feeding roller which is provided above the sheet stacking portion and feeds the sheets stacked on the sheet stacking portion;

a supporting portion which supports the sheet feeding roller so that the sheet feeding roller is movable in an up-down direction;

a roller biasing member which biases the sheet feeding roller in a direction pressing the sheet feeding roller onto the sheets stacked on the sheet stacking portion;

a separating member which is pressed onto the sheet feeding roller and separates the sheets fed by the sheet feeding roller one by one; and a guide portion which guides the sheets from below to a pressing portion between the sheet feeding roller and the separating member, wherein the guide portion is linearly lowered together with the separating member with the downward movement of the sheet feeding roller biased by the roller biasing member.

8. The image forming apparatus according to claim 7, further comprising a separating member supporting portion which supports the separating member and is movable in the up-down direction, the guide portion being provided on the separating member supporting portion at an upstream in a sheet feeding direction of the pressing portion.

9. The image forming apparatus according to claim 7, further comprising a fixing guide which guides the sheets to the pressing portion between the sheet feeding roller and the separating member, the fixing guide being arranged below the tangent line of the sheet feeding roller when the pressing portion is at a lower limit.

10. An image forming apparatus in which an image forming portion forms an image on a sheet fed from a sheet feeding device, wherein the sheet feeding device has:

a sheet storing portion having a sheet stacking portion which stacks sheets thereon and can be lifted and lowered;

a sheet feeding roller which is provided above the sheet stacking portion and feeds the sheets stacked on the sheet stacking portion;

a supporting portion which supports the sheet feeding roller so that the sheet feeding roller is movable in an up-down direction;

a roller biasing member which biases the sheet feeding roller in a direction pressing the sheet feeding roller onto the sheets stacked on the sheet stacking portion;

a separating member which is pressed onto the sheet feeding roller and separates the sheets fed by the sheet feeding roller one by one; and a separating roller supporting portion which holds the separating member;

a separating holder which slidably holds the separating roller supporting portion in an up-down direction; and a guide portion which is provided on the separating roller supporting portion and guides the sheets fed by the sheet feeding roller to a pressing portion between the sheet feeding roller and the separating member.

11. The image forming apparatus according to claim 10, wherein the supporting portion includes a sheet feeding frame which supports the sheet feeding roller so as to be slidable up and down.

12. The image forming apparatus according to claim 10, wherein the supporting portion includes a sheet feeding roller holder which is turned about a supporting point and rotatably supports the sheet feeding roller so as to be up and down.

* * * * *